US006822149B1

(12) United States Patent
Liao

(10) Patent No.: US 6,822,149 B1
(45) Date of Patent: Nov. 23, 2004

(54) DRUM PULSATILE

(76) Inventor: Tsun-Chi Liao, 1F, No. 7, Lane 545, Sec. 2, Chun-Kung Rd., Taichung City (TW)

( * ) Notice: Subject to any disclaimer, the term of this patent is extended or adjusted under 35 U.S.C. 154(b) by 43 days.

(21) Appl. No.: 10/426,690

(22) Filed: May 1, 2003

(51) Int. Cl.[7] ..... G10D 13/02

(52) U.S. Cl. ..... 84/422.1; 84/422.2; 84/422.3

(58) Field of Search ..... 84/422.1, 422.2, 84/422.3

(56) References Cited

U.S. PATENT DOCUMENTS 5,365,824 A * 11/1994 Hoshino ..... 84/422.1
5,798,472 A * 8/1998 Shigenaga ..... 84/422.1
6,239,342 B1 * 5/2001 Chang ..... 84/422.1

* cited by examiner

*Primary Examiner*—Shih-Yung Hsieh
(74) *Attorney, Agent, or Firm*—Birch, Stewart, Kolasch & Birch, LLP

(57) ABSTRACT

A drum pulsatile for achieving agile and labor saving operation includes a base and an anchor rack located at the front side of the base which has an transverse upper rod located on the top section thereof. The upper rod is coupled with a rocking wheel which is fastened to a beater. The base has a rear end pivotally engaged with a pedal. The pedal has a front end fastened to a chain which winds around the front peripheral surface of the rocking wheel and has a distal end fastening to the rocking wheel. There is an elastic adjustment unit located on one side of the base that has an upper end coupling with the upper rod and a lower end movably connecting to the base thereby enables a drummer to step on the pedal in an agile and labor-saving manner at a faster speed to hit the drum.

6 Claims, 6 Drawing Sheets

DRUM PULSATILE

FIELD OF THE INVENTION

The present invention relates to a drum pulsatile and particularly to a drum pulsatile that has an elastic adjustment unit located on one side of the pedal base with a movably linking low end to provide agile and fast pedal operation.

BACKGROUND OF THE INVENTION

Referring to FIG. 1, a conventional drum pulsatile mainly includes a base 1 which has a rear end pivotally engaged with a pedal 2 and a front end fastened to a upright anchor rack 3. The anchor rack 3 has a transverse rod 4 on the top section to couple with a rocking wheel 5. The front end of the pedal 2 is fastened to a chain 6 which winds around the front surface of the rocking wheel 6 and has one distal end fastened to the rocking wheel 5 to hoist the pedal 2 to form a sloped angle so that the drummer can step on the pedal 2 to move a beater 5A fastened to the rocking wheel 5 to hit the drum (not shown in the drawing).

The turning easiness of the transverse rod 4 affects the agility of the pedal 2 and hitting force. Too tight or too loose is not desirable. Hence there is often an adjusting unit 7 located on an outer side of the anchor rack 3 to control the turning tightness of the transverse rod 4. The adjusting unit 7 has a connection head 7A at the upper side coupling with one end of the transverse rod 4. The connection head 7A has a lower side pivotally engaged with a spring 8. A fastening head 9 is provided which has a top end coupled with a bolt 9A. The bolt 9A runs through a hole 3B formed on a lug 3A which extends outside the anchor rack 3 to couple with an adjusting nut 3C. The hole 3B has a bottom section forming a hexagonal cavity 3D matching a hexagonal stub 9B formed on the top section of the fastening head 9 to prevent the fastening head 9 from turning freely.

When in use, the chain 6 at the front end of the pedal 2 pulls the rocking wheel 5 turning downwards, the connection head 7A located on the outer side of the transverse rod 4 which couples with the rocking wheel 5 also is turned. Hence the spring 8 hooked on the connection head 7A is hoisted upwards. The spring 8 is moved in a biased manner (as shown in FIG. 2). Once the foot is released, the restoring force of the spring 8 pulls the pedal to its original sloped position. As the conventional techniques use the restoring force of the spring 8 to hoist the pedal 2 with the spring 8 deformed under forces, and the fastening head 9 cannot swing, the force applying on the pedal is heavy and operation is stiff.

SUMMARY OF THE INVENTION

In view of the aforesaid disadvantages, the invention provides a drum pulsatile structure that is agile to operate and takes less efforts, thus effectively overcomes the problems of heavy and stiff operation occurred to the conventional drum pulsatiles.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
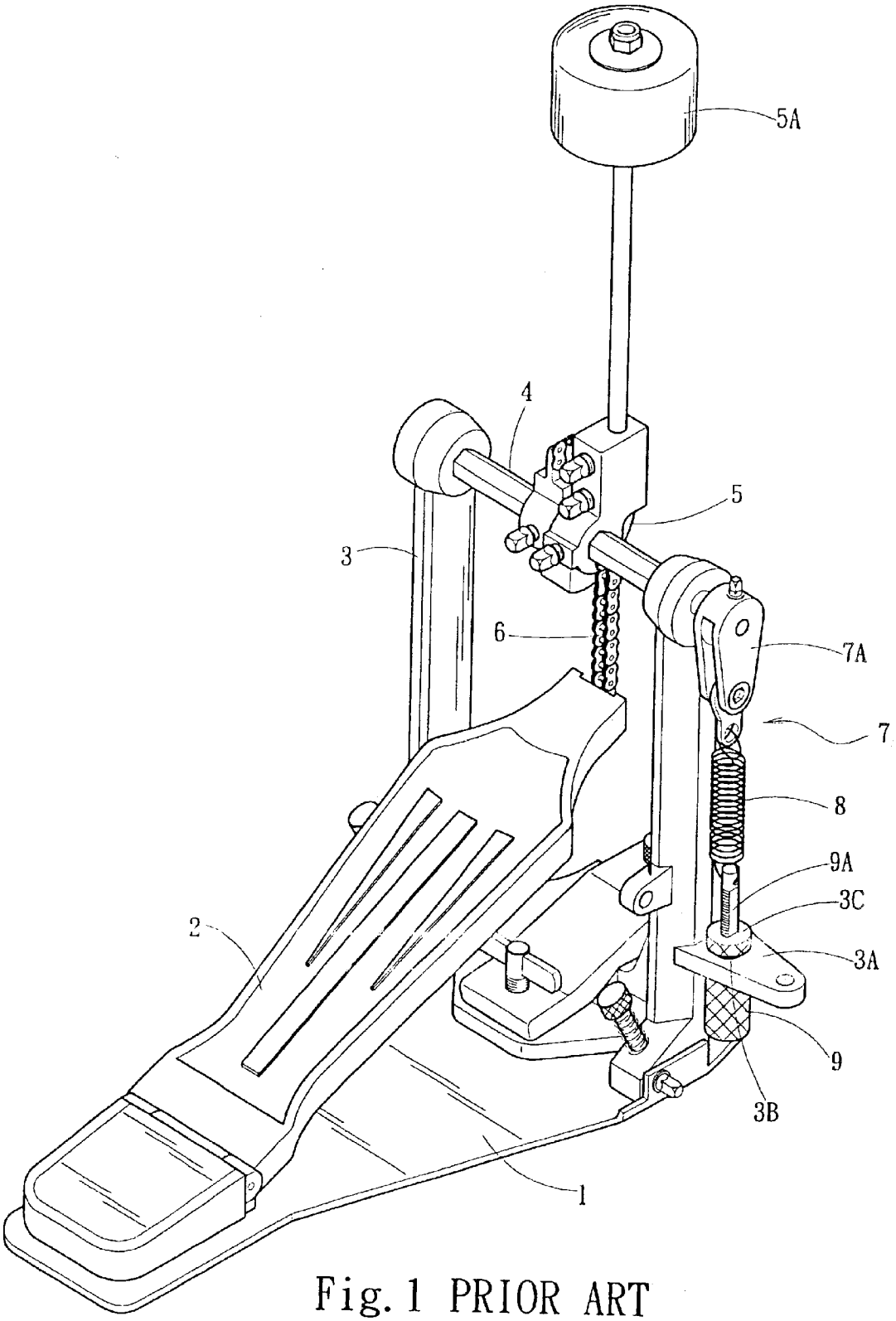
Fig. 1 PRIOR ART
FIG. 1 is a perspective view of a conventional drum pulsatile.
Figure 2:
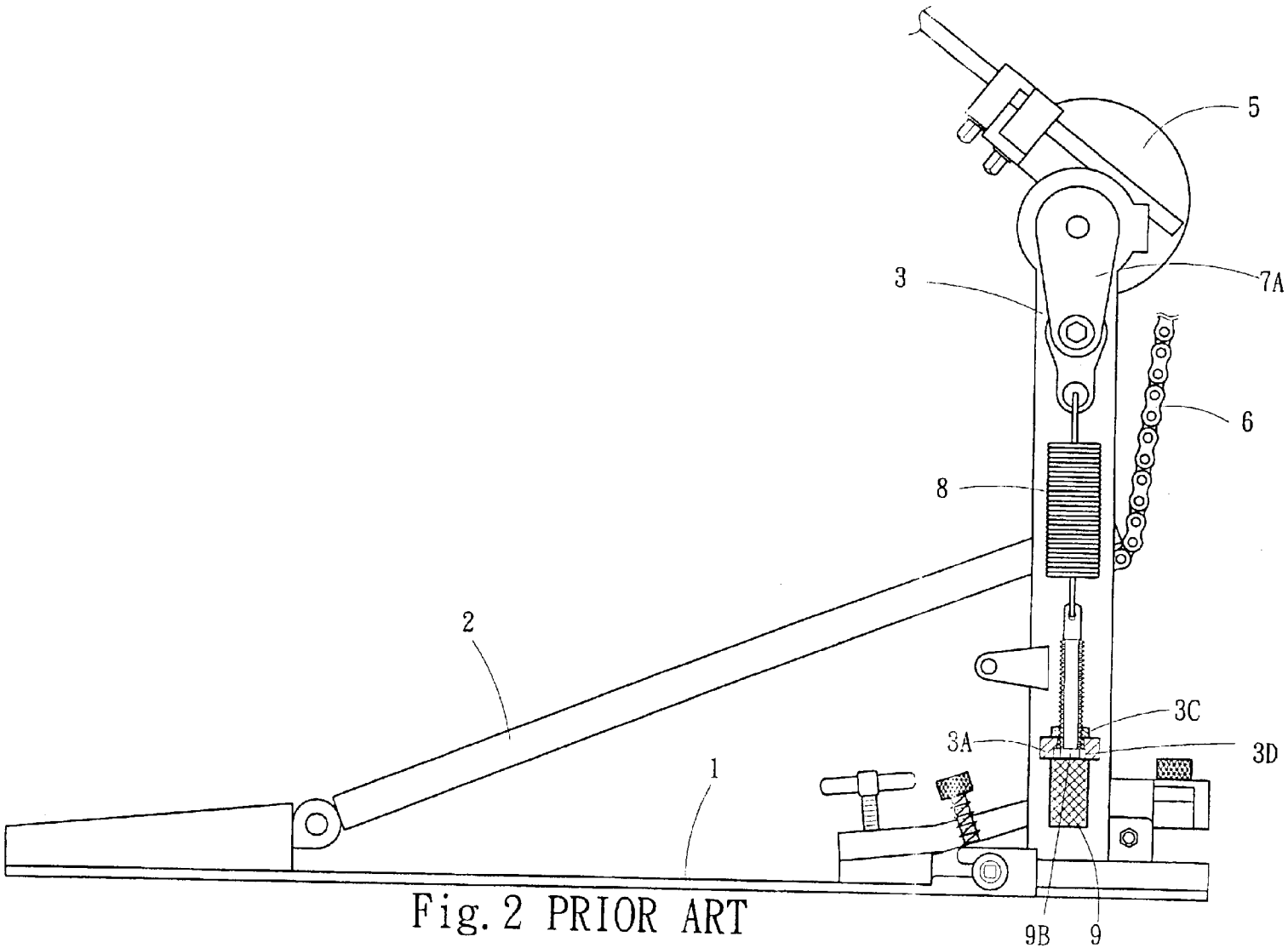
Fig. 2 PRIOR ART
FIG. 2 is a sectional view of a conventional drum pulsatile.
Figure 3:
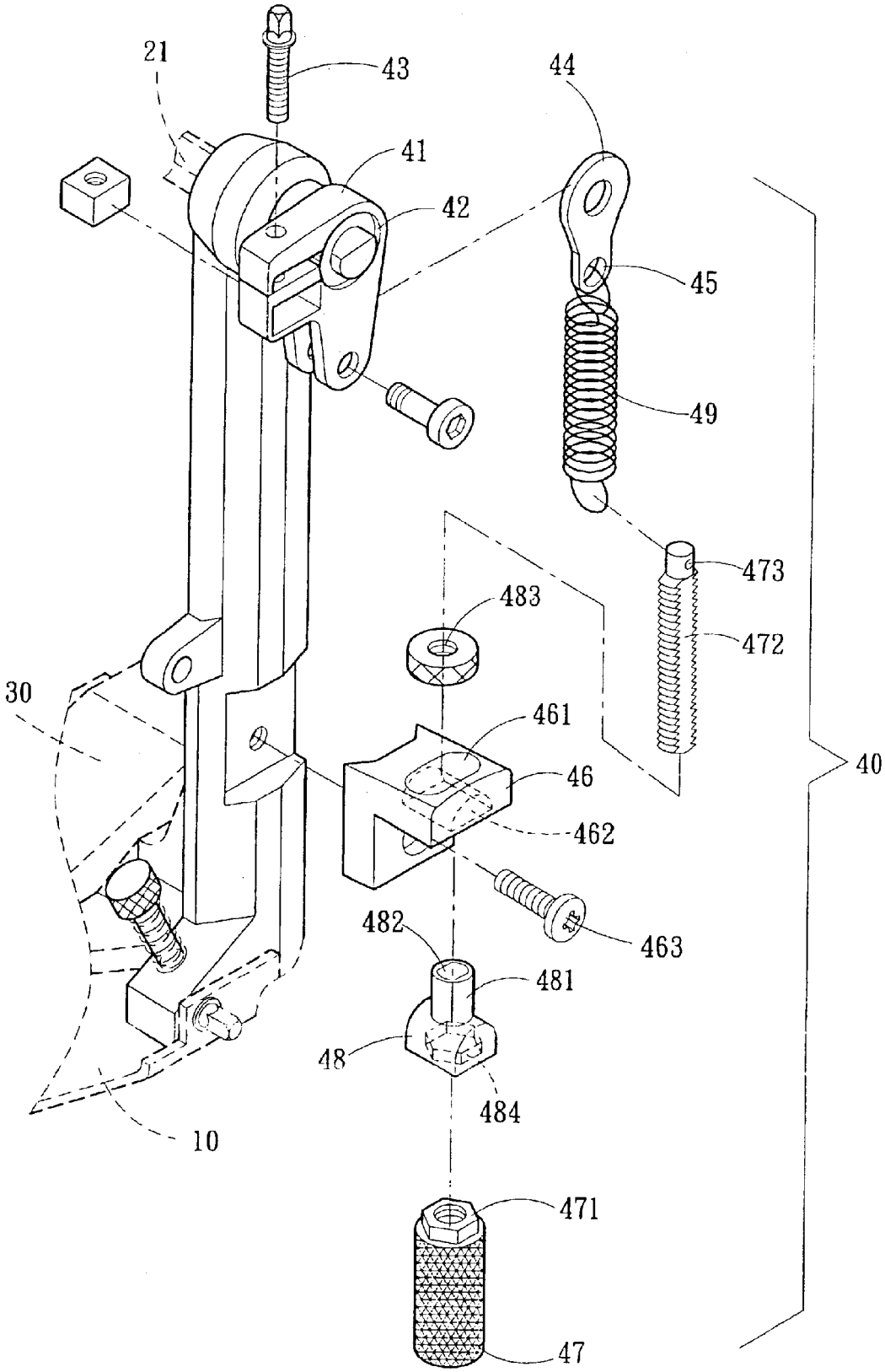
FIG. 3 is an exploded view of a preferred embodiment of the present invention.
Figure 4:
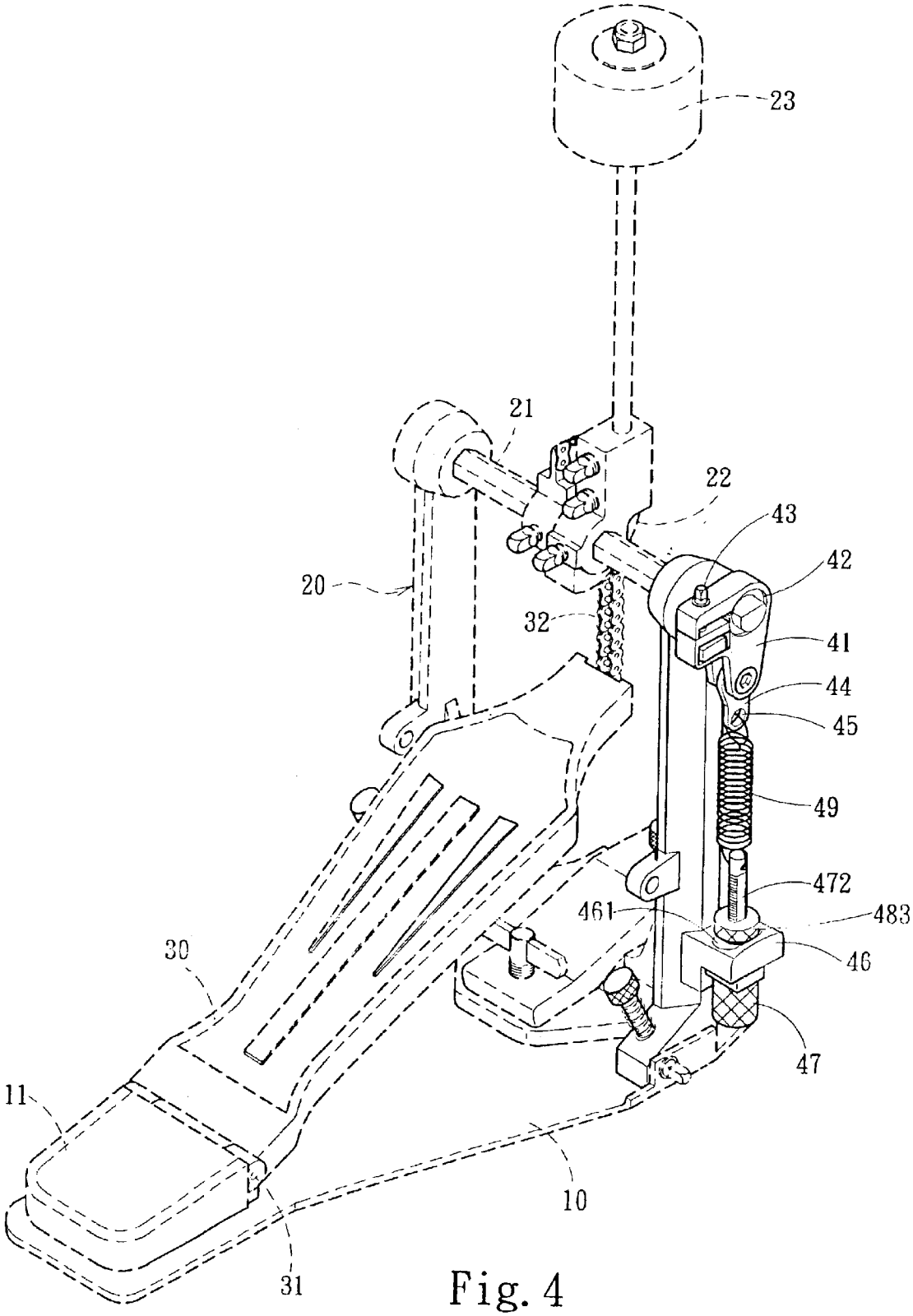
FIG. 4 is a perspective view of a preferred embodiment of the present invention.
Figures 5A, 5B:
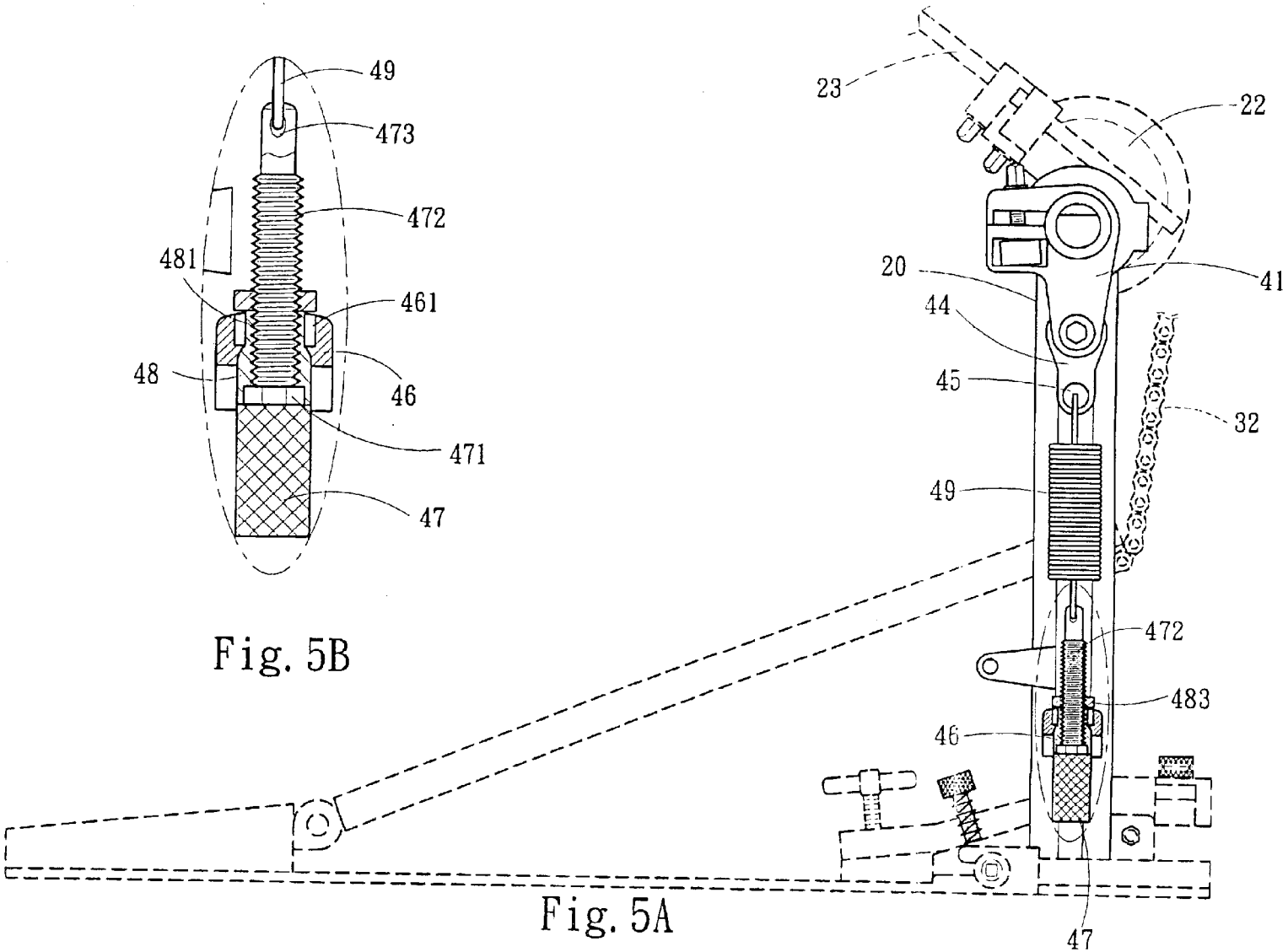
FIG. 5A is a schematic view of a preferred embodiment of the present invention showing the pedal and spring in a released condition.
FIG. 5B is a fragmentary enlarged view of FIG. 5A.

Referring to FIGS. 3 and 4, the drum pulsatile according to the invention consists of:

a base 10 laid on a floor having a horizontal pivotal seat 11 located on the rear end thereof;

an anchor rack 20 formed substantially in a rectangular frame and erected in an upright manner at the front side of the base 10 having an transverse upper rod 21 located on the top section thereof. The upper rod 21 is coupled with a semicircular rocking wheel 22 which is fastened to a beater 23. The beater 23 may be swung by the rocking wheel 22 to hit a drum (not shown in the drawings);

a pedal 30 having a rear end pivotally engaged with the pivotal seat 11 of the base 10 through an axle 31. The front end of the pedal 30 is fastened to a chain 32 which winds around the front peripheral side of the rocking wheel 22 and has a distal end fastening to the rocking wheel 22 to hoist the pedal 30 at a sloped angle with a higher front end and a lower rear end;

an elastic adjustment unit 40 (also referring to FIGS. 5A and 5B) located on one side of the anchor rack 20 including a connection head 41 which has a hole 42 to couple on an outer side of the upper rod 21. The connection head 41 has one side forming an upper clip and a lower clip which may be fastened by a screw 43 to tightly couple on the upper rod 21 so that the connection head 41 may be swung synchronously with the upper rod 21. The connection head 41 further has a lower end pivotally engaging with a pendant member 44 which may swing freely. The pendant member 44 has a bottom forming a hooking lug 45. There is a fastening flange 46 located on an outer side of the anchor rack 20. The fastening flange 46 has a vertical slot 461 in parallel with the front and rear direction of the pedal 30. The fastening flange 46 further has a transverse cavity 462 formed on the bottom thereof. The top side of the cavity 462 is formed in an arched profile directing downwards. A cylindrical fastening head 47 is provided which has a polygonal brake section 471 formed on an upper side thereof. The brake section 471 has a center bore on the top end to engage with a bolt 472. The left side and the right side of the bolt 472 form respectively a flat surface. A movable bucking member 48 is provided which has an arched top section mating the arched top profile of the cavity 462 so that the bucking member 48 may swing forwards and rearwards in the cavity 462. The bucking member 48 has a fastening section 481 formed in a round strut on the upper side thereof and a through hole 482 formed in the center. The hole 482 has two flat surfaces on two sides such that the bolt 472 may run through the slot 461 of the fastening flange 46 and the through hole 482 of the movable bucking member 48 to couple with an adjusting nut 483 at the upper section of the bolt 472. The bolt 472 has a transverse hole 473 at the top end. The movable bucking member 48 further has a polygonal cavity 484 on the bottom to couple with the brake section 471 of the fastening head 47 to prohibit the fastening head 47 from turning. An elastic element such as a spring 49 which is extensible axially is provided. The spring 49 has a lower end engaging with the transverse hole 473 of the bolt 47 and an upper end engaging with the hooking lug 45 of the pendant 44.

Figures 6A, 6B:
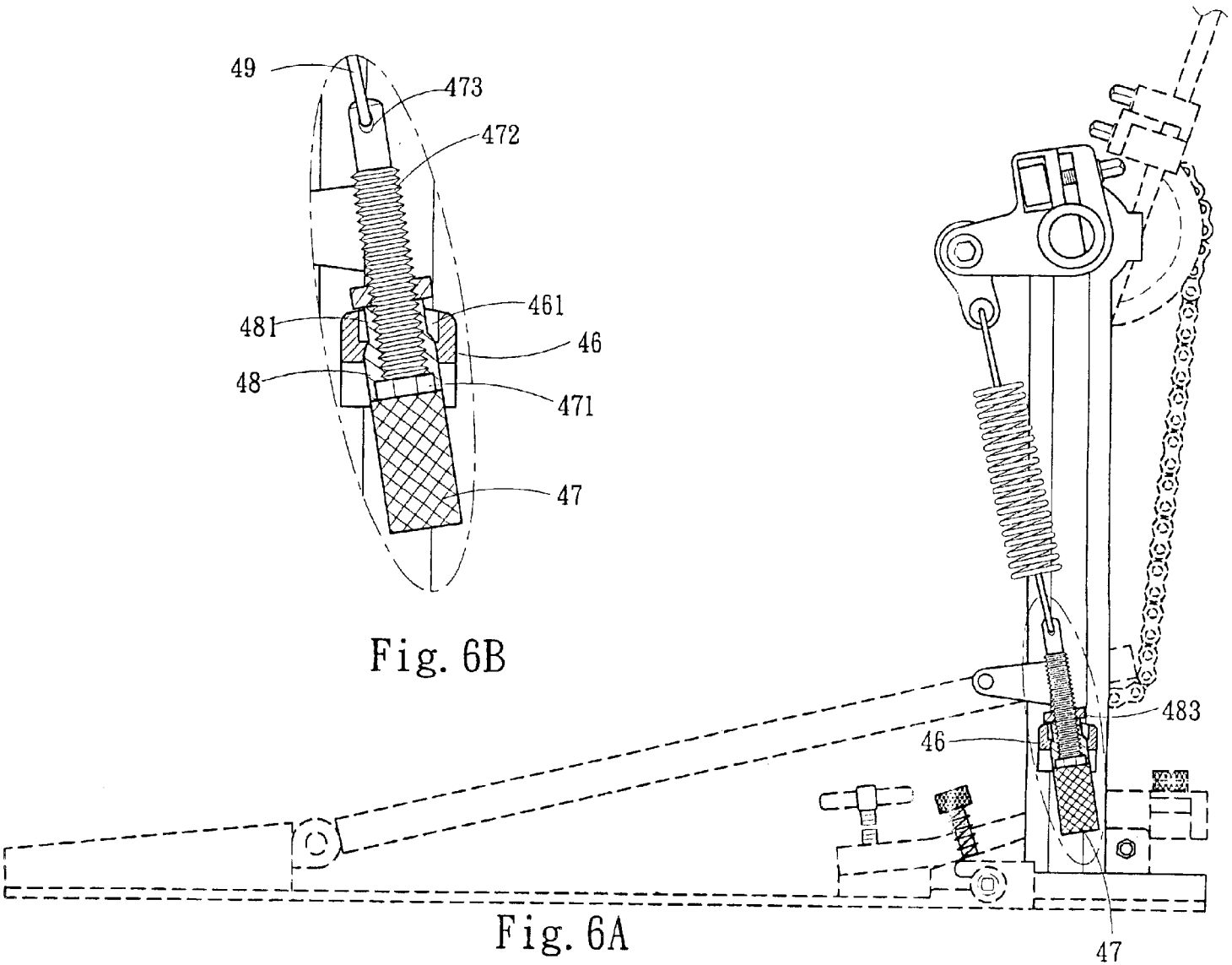
FIG. 6A is a schematic view of a preferred embodiment of the present invention showing the pedal and spring subject to a force.
FIG. 6B is a fragmentary enlarged view of FIG. 6A.

Referring to FIGS. 6A and 6B, when in use, user's foot steps on the pedal 30, the chain 32 at the front end of the pedal 30 pulls the rocking wheel 22 turning which in turn moves the beater 23 to hit the drum. The connection head 41 located on the top end of the elastic adjustment unit 40 also is turned by the upper rod 21. The pendant member 44 is hoisted by the connection head 41 and moved in a biased manner. The spring 49 is hoisted by the pendant 44 and stretched under force in a biased manner like the pendant 44. The bottom of the spring 49 pulls the bolt 472 which runs through the movable bucking member 48, thus the movable bucking member 48 is moved and rocked. As the strut-shaped fastening section 481 on the top end of the movable bucking member 48 runs thought the slot 461 of the fastening flange 46, it can swing freely forwards and rearwards in the slot 461. Moreover, the top section of the movable bucking member 48 is formed in the arched shape mating the arched cavity 462 of the fastening flange 46, it also can swing freely forwards and rearwards. Therefore the lower end of the spring 49 becomes a free end and may swing freely. Hence when user's foot steps on the pedal 30, the movable bucking member 48 may swing under the stretching of the spring 49 so that the spring 49 may be prevented from bending excessively. As a result, foot stepping force can be reduced, and turning of the rocking wheel 22 is more agile and easier.

It is well known that drummers usually have to move hands and feet vigorously during performance. With the required foot stepping force decreased, the speed of hitting the drum may increase. This is especially helpful to achieve desired precision when performing music of fast rhymes and beats. And consequently improved audio effect can be achieved. Therefore, with the improvement of the invention, the disadvantage of less precision caused by heavy foot stepping of the conventional drum pulsatiles may be eliminated. Furthermore, the fastening head 47 may be turned when the spring 49 is hoisted upwards, the instant magnitude of the pedal 30 hoisted by the spring 49 is smaller (i.e. deformation of the spring 49 may be maintained at a minimum range). Thus the beater 23 driven by the pedal 30 may hit the drum with a greater agility and at a faster speed. It also saves the drummer a lot of efforts to step on the pedal 30.

What is claimed is:

1. A drum pulsatile for achieving agile and labor saving operation, comprising:

a base laid horizontally;

an anchor rack located at a front side of the base having a transverse upper rod located on the top section thereof, the upper rod being coupled with a rocking wheel which is fastened to a beater for hitting a drum;

a pedal having a rear end pivotally engaged with a rear side of the base and a front end fastened to a chain which winds around the front peripheral side of the rocking wheel and has a distal end fastened to the rocking wheel to hoist the pedal in a sloped manner with a higher front end and a lower rear end; and an elastic adjustment unit located on one side of the anchor rack including:

a connection head coupling on one side of the upper rod;

an elastic element connected to a lower end of the connection head being extensible axially;

a fastening flange extended from an outer side of the anchor rack having a vertical slot formed in the forward and rearward direction, the slot having a cavity formed on a bottom section thereof;

a fastening head having a top end engaging with an adjusting nut to fasten to a bolt which has a top end engaging with the elastic element; and a movable bucking member located on the top end of the fastening head being coupled with the cavity for swinging forwards and rearwards, the movable bucking member having a fastening section located on an upper side thereof to couple with the slot of the fastening flange.

2. The drum pulsatile of claim 1, wherein the cavity of the fastening flange has an arched top surface directing downwards, the movable bucking member having a transverse arched top surface corresponding to the arched top surface of the cavity.

3. The drum pulsatile of claim 1, wherein the connection head has a lower end pivotally engaging with a pendant member which has a lower section forming a hooking lug to engage with the elastic element.

4. The drum pulsatile of claim 1, wherein the elastic element is a spring.

5. The drum pulsatile of claim 1, wherein the fastening head has an upper section forming a polygonal brake section, the bolt being engaged with the center of the brake section of the fastening head, the movable bucking member having a hole in the center to allow the bolt to run through and a bottom section matching the shape of the brake section.

6. The drum pulsatile of claim 5, wherein the hole has two flat surfaces on the left side and the right side, the bolt having two flat sides corresponding to the hole and a transverse hole on the top section thereof.

* * * * *